United States Patent [19]

Simpson

[11] Patent Number: 4,589,504

[45] Date of Patent: May 20, 1986

[54] WELL BORE ENLARGER

[75] Inventor: Neil A. A. Simpson, Aberdeen, Scotland

[73] Assignee: Diamant Boart Societe Anonyme, Brussels, Belgium

[21] Appl. No.: 634,956

[22] Filed: Jul. 27, 1984

[51] Int. Cl.[4] ..... E21B 10/26; E21B 10/32

[52] U.S. Cl. ..... 175/267; 175/269; 175/406

[58] Field of Search ..... 175/263, 267, 269, 284, 175/406, 407, 339, 422

[56] References Cited

U.S. PATENT DOCUMENTS

| | | | |
|---|---|---|---|
| 1,485,249 | 2/1924 | Craig | 175/406 X |
| 2,069,482 | 2/1937 | Seay | 175/269 |
| 2,344,598 | 3/1944 | Church | 175/406 X |
| 2,859,943 | 1/1957 | Chadderdon | 255/76 |
| 3,171,503 | 5/1962 | Shirley | 175/269 |
| 3,208,540 | 3/1963 | Park | 175/269 |
| 3,237,705 | 3/1966 | Williams, Jr. | 175/406 |
| 3,749,187 | 7/1973 | Leathers | 175/269 |
| 3,757,877 | 9/1973 | Leathers | 175/269 |
| 3,894,590 | 7/1975 | Takano et al. | 175/269 |
| 4,282,941 | 8/1981 | Perkin | 175/269 |
| 4,431,065 | 2/1984 | Andrews | 175/269 |

FOREIGN PATENT DOCUMENTS

| | | | |
|---|---|---|---|
| 111878 | 8/1965 | Netherlands | 175/267 |

OTHER PUBLICATIONS

Topservices, 1982-83 Catalog—Hole Openers and Underreamers.
Industrialexport 1974-75 Catalog—Rock Bit Underreamers.
Baker 1974-75 Catalog—Lockomatic Expanding Hole Opener.
Eureka 1962-63 Catalog-Swan Underreamers.
Grant 1982-83 Catalog—Blade Wall Scraper, Rock Bit Underreamer, Hole Enlarger.
Drilling & Service, 1982-83 Catalog—Diamond Underreamer.
A-1 1982-83 Catalog—Expandable Underreamer.
A-Z 1982-83 Catalog—Hard Rock Underreamer, Rock Bit Underreamer, Dual Rock Type Underreamer, Section Mill.
Servco 1968-69 Catalog—Section Mill/Casing Cutter, Rock-Type Hole Opener, Rock Crilling-Hole Opener.
Servco 1982-83 Catalog—Rock-Type Underreamer, Drilling-Type Underreamer, Two-Stage Underreamer.
Tri-State 1982-83 Catalog—Lockomatic Expanding Hole Opener, Fixed Hole Opener, Section Mill.
Lor 1982-83 Catalog—Rock-Type Underreamer, Drilling-Type Underreamer.

*Primary Examiner*—Stuart S. Levy
*Assistant Examiner*—Thomas R. Hannon
*Attorney, Agent, or Firm*—Arnold, White & Durkee

[57] ABSTRACT

A well bore enlarger comprising, in its fixed-arm embodiment, a tubular housing member having an enlarged section with an outer diameter substantially the same as the well bore diameter, the enlarged section having a plurality of longitudinal cut-out portions defining blades of the enlarged section therebetween; a longitudinal slot within the blade; a cutting arm mounted to the blade within the slot having cutting edges and a fluid gallery between the cutting edges which gallery communicates with the slot and the well bore; synthetic diamond material attached to the cutting arm; and means on the tubular housing member for directing a fluid through the fluid gallery of the cutting arm. In the expandable-arm embodiment of the well bore enlarger, the tubular housing member is formed with the enlarged section as previously described, with slots, blades and cut-out portions. The expandable-arm embodiment further comprises a cutting arm which is pivotally mounted within the blade and moveable between radially retracted position wherein the cutting arm is disposed essentially within the outer diameter of the enlarged section and a radially extended position wherein the outer edge of the cutting arm is disposed essentially outside the diameter of the enlarged section and the inner edge of the cutting arm remains at all times essentially within the outer diameter of the enlarged section; stop means within the blade and engageable with the cutting arm to limit outward movement of the cutting arm; synthetic diamond material attached to the cutting arm; a tubular drive member slidably mounted within the tubular housing member, the drive member including a piston actuated by hydraulic fluid; means on the cutting arm and drive member for moving the cutting arm from its retracted position to its extended position; and means on the drive member for directing fluid toward the cutting edges of the cutting arm.

16 Claims, 6 Drawing Figures

12
46
96
10
56
66
64
68
90
58
3
3
92
94
84
74
14
62
82
22
4
28
4
32
34
80
78
5
5
36
76
40
38
"Y"
40
70
38
"X"
100
98
88
86
102
16
104
106
72
108
110
60

WELL BORE ENLARGER

BACKGROUND OF THE INVENTION

This invention relates generally to a new and improved tool for enlarging well bores. More particularly, this invention concerns a novel well bore enlarger utilizing synthetic diamond cutting technology.

In the past, it has been common to use tools to open or to underream well bores. Most such tools utilize roller cone-type cutters which are not as effective in cutting through many sedimentary formations as are tools using synthetic diamond material. The cone-type cutters may also have moving parts, such as cones and bearings, which may break off during use and fall into the well bore.

In the past, such expandable-arm tools have been built to create a neutral turning moment or inward turning moment about the hinged mechanism securing the cutting arms to the tool. This was done because the mechanism stopping the expansion of the cutting arm was not strong enough to support outward turning moments. To support the inward turning moment, such tools had to be provided with a locking mechanism behind the cutting arm to lock the arm in its open position. Locking mechanisms are not always reliable and, if the cutting arm fails to close, the tool cannot be brought to the surface if it has passed through a restriction in the well bore while in the closed position, i.e., if only the lower part of the well bore has been enlarged. An expensive fishing operation is then required to recover the tool, which, if unsuccessful, could mean abandonment of the well.

Attempts have been made to adapt previous tools for use with synthetic diamond cutting technology. these attempts have failed because of the lack of strength and stability of previous tools and because of the inability of previous tools to provide adequate cleaning and cooling of the synthetic diamond cutting surfaces. Synthetic diamond material cannot tolerate high levels of vibration or shock loading. In order to efficiently cut through a formation, the synthetic diamond cutting surfaces must be well cleaned. Additionally, the synthetic diamond material will debraze and break down if not properly cooled during cutting.

Attempts have been made to provide solutions to the problems which arise in using synthetic diamond cutting surfaces in well bore enlarging tools, such as U.S. Pat. No. 4,431,065 to Andrews which addresses the necessity for cooling and cleaning the cutting surfaces. The tool disclosed in Andrews suffers from a number of disadvantages. The geometric configuration of the cutting arm is such that fluid does not flow directly toward the cutting surface when the arm is fully extended, thus lessening the cooling and cleaning effect. Andrews does not disclose the ability to fit interchangeable nozzles to create optimum hydraulics at the cutting faces and below the tool. The problems of vibration and shock loading are not addressed by Andrews.

The need exists for a tool which can utilize synthetic diamond cutting technology and which overcomes the problems inherent in the use of such technology. The present well bore enlarger addresses and solves such problems.

SUMMARY OF THE INVENTION

The present invention provides a novel well bore enlarger that minimizes or reduces the deficiencies and disadvantages of underreamers and hole openers of the type previously noted, and provides a number of beneficial results. For example, the enlarged diameter portion of the tool's body reduces vibration which causes cutting arm failure, ensures that the cutting arms will cut in a circular path, allows for cutting arms of thicker width, and allows for larger attachment means between the body and the cutting arm, thus safely increasing the load capacity of this connection.

The configuration of the cutter arm, and its position within the tool's body when performing its cutting function, reduce shock loading, allow bending loads to be supported over the entire length of the cutting arm, and, due to the large outward turning moment created, eliminate the need for a device on the tool to lock the cutter arm in its open position if the expandable-arm embodiment of the tool is being used.

The cutting face configuration, in cooperation with the means for directing fluid to the cutting face surfaces, insures greater cooling and cleaning of the cutting face surfaces and the slots which house the cutting arms.

The configuration of the enlarged diameter portion of the tool's body allows for passage of fluids up the well bore between the bore and the enlarged diameter portion, without sacrificing the stabilizing effects of the enlarged portion's extension into the well bore below the cutting arms. This fluid-flow up the well bore also aids in cooling the cutting face surfaces.

The means for directing fluid to the cutting face surfaces is positioned so that the fluid is also jetted at high velocity perpendicular to the sidewalls of the well bore, attacking the planes of any sedementary formation and aiding in breaking up such formation, thus allowing for easier enlargement of the well bore.

The fluid directing means allow for the easy variation of the amount of fluid to be directed to the cutting face surfaces and to be directed below the tool whether a pressurized system is attached below the tool or not.

The present invention provides a well bore enlarger which comprises a tubular housing member adaptable for connection to a drill string or the like. The tubular housing member has an enlarged section with a diameter substantially the same as the diameter of the well bore. The enlarged section has a plurality of longitudinal cut-out portions extending along its entire length. The cut-out portions define blades of the enlarged section therebetween. The cut-out portions also provide fluid passageways between the well bore and the enlarged section for the passage of fluid up the well bore. The blade contains a longitudinal slot within which a cutting arm is mounted. The cutting arm has an inner, outer and cutting edges. The cutting arm is mounted so that the inner edge is essentially within the outer diameter of the enlarged section. The cutting arm contains a plurality of synthetic diamond cutting edges. Means are provided on the tubular housing member for directing fluid toward the cutting edges of the cutting arms.

In its expandable-arm embodiment, the cutter arms are pivotally mounted to the blade within the slot and movable between a radially retracted position wherein the arm is disposed essentially within the outer diameter of the enlarged section, and a radially extended position. The blade contains stop means which engage the cutter arm to limit the outward movement of the cutter arm so that when the arm is in its fully extended position, its inner edge remains at all times essentially within the outer diameter of the enlarged section.

Slidably mounted within the housing member is a tubular drive member which includes a piston actuated by hydraulic fluid and means for moving the cutter arm from its retracted position to its extended position. In the invention's expandable-arm embodiment, the means for directing fluid toward the cutting edges of the cutting arm are provided on the drive member rather than on the housing member.

Examples of the more important features of this invention have been summarized broadly in order that the detailed description thereof that follows may be better understood. There are, of course, additional features of the invention that will be described hereinafter and which will also form the subject matter of the claims appended hereto. Various other advantages and features of this invention will become apparent to those skilled in the art from the following discussion, taken in conjunction with the accompanying drawings.

BRIEF DESCRIPTION OF THE DRAWINGS

In The Drawings.

In most cases, like reference numerals have been applied to like elements in each of the various drawings.

DETAILED DESCRIPTION

It will be appreciated that the present invention can take many forms and embodiments. Some embodiments of the invention are described so as to give an understanding of the invention. It is not intended that the illustrative embodiments described herein should limit the invention.

Figure 1:
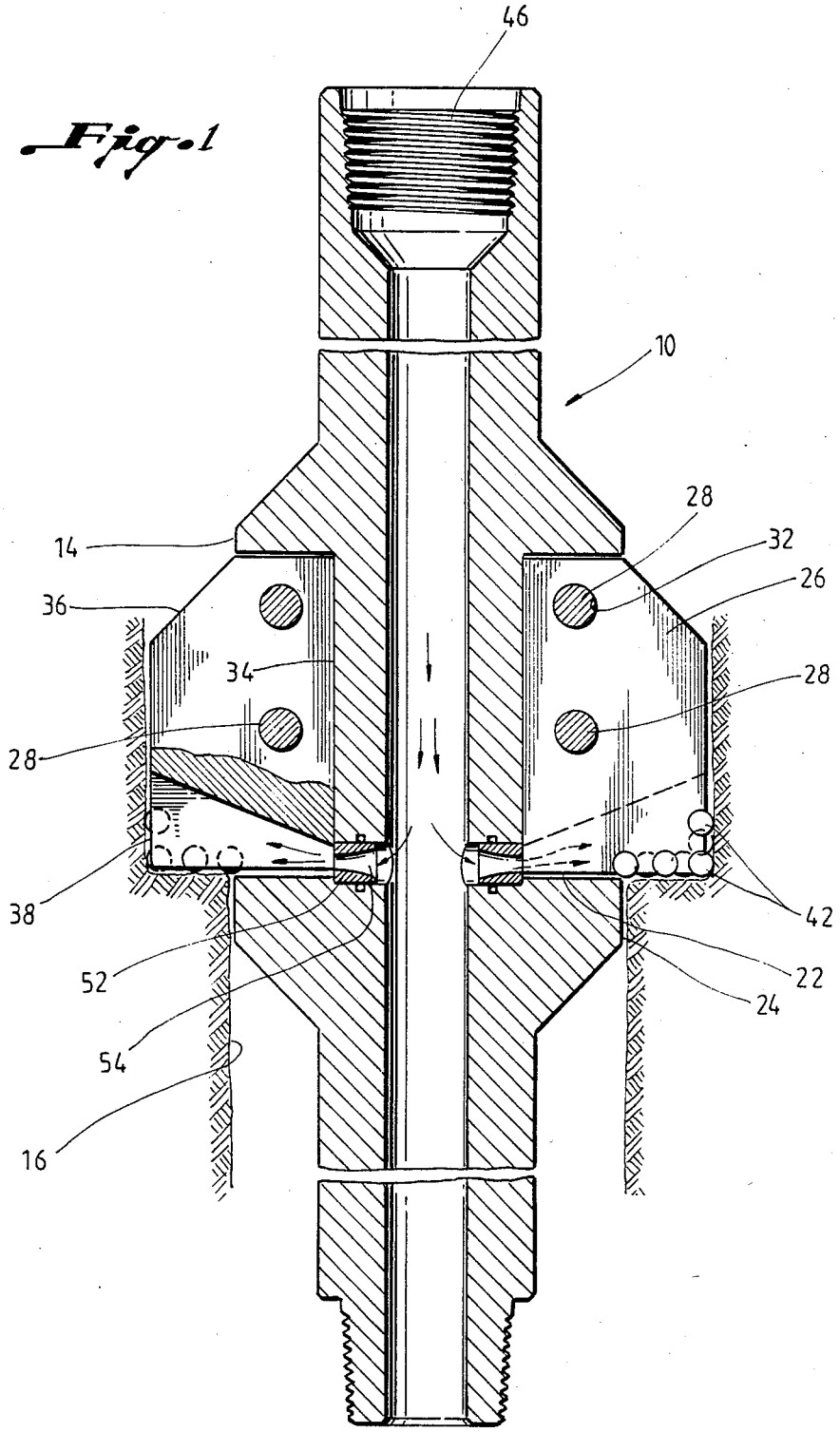
FIG. 1 is a sectional view of the fixed-arm embodiment of the invention.
Figure 2:
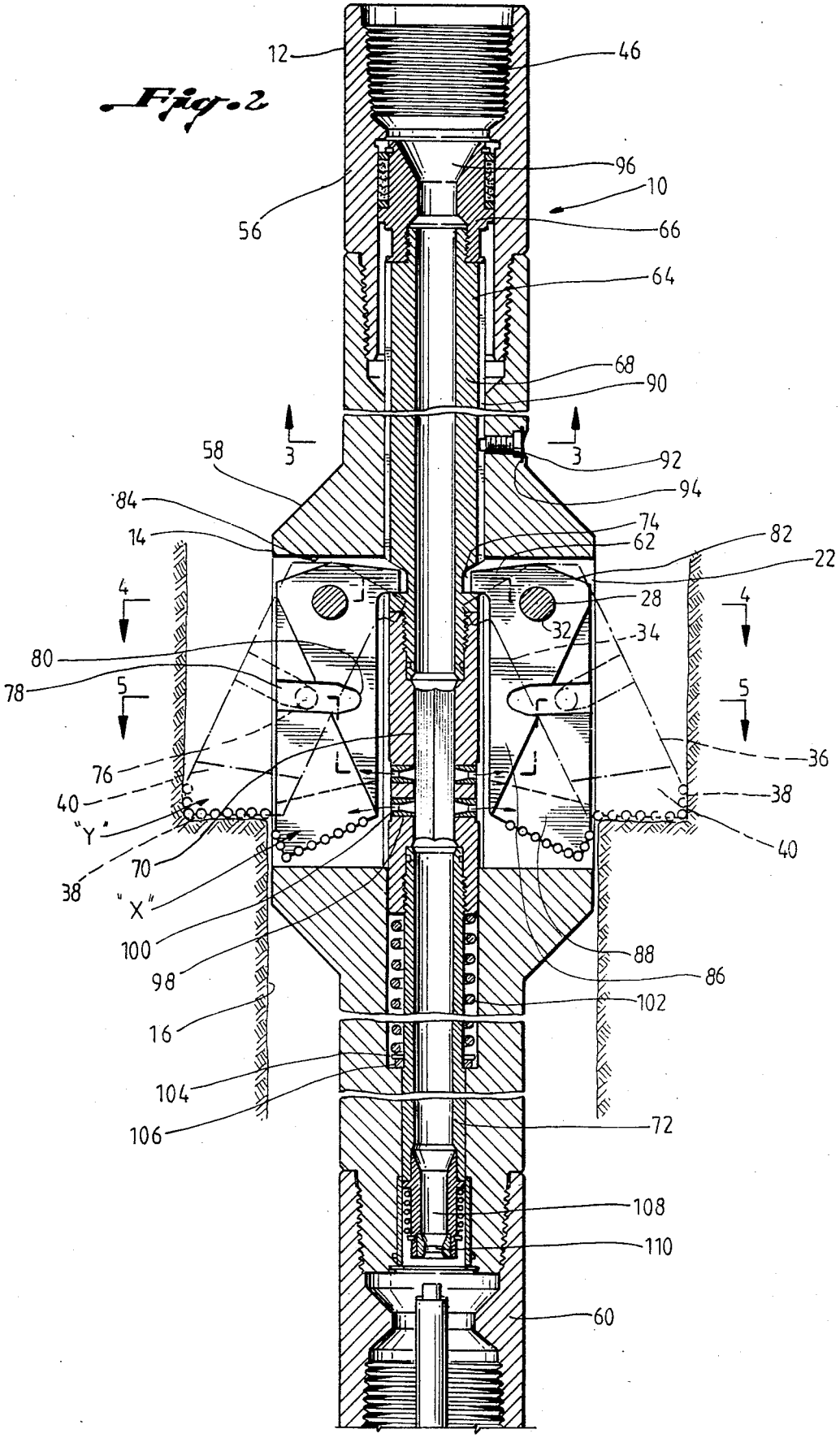
FIG. 2 is a sectional view of the expandable-arm embodiment of the invention, in a retracted and an open position (open position indicated with dotted lines).

Referring to the drawings, in particular FIG. 1, there is shown a well bore enlarger 10 which is the fixed-arm embodiment of the present invention. Well bore enlarger 10 comprises a tubular housing member 12 which is adaptable for connection to a drill string or the like (not shown). The tubular housing member 12 may be in one section as illustrated in FIG. 1, or may be made up of multiple sections as illustrated in FIG. 2. Tubular housing member 12 is preferably machined from a solid "4142" grade steel forging.

Tubular housing member 12 has an enlarged section 14 with a diameter substantially the same as the diameter of the well bore 16 to be enlarged.

Figure 4:
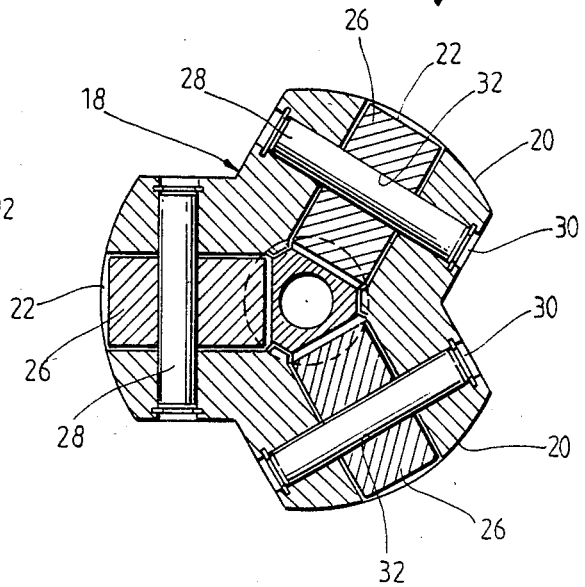
FIG. 4 is a cross-sectional view of the expandable-arm embodiment of the invention taken along the line 4—4.
Figure 5:
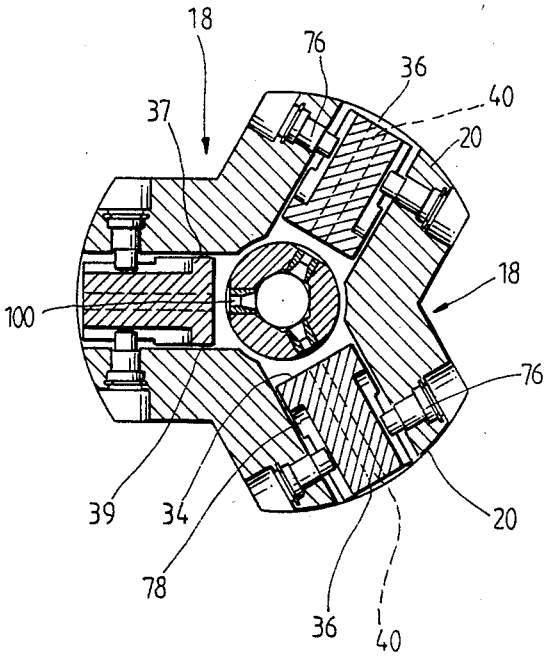
FIG. 5 is a cross-sectional view of the expandable-arm embodiment of the invention taken along the line 5—5.

The enlarged section has a plurality of longitudinal cut-out portions 18, best seen in FIGS. 4 and 5, such cut-out portions extending along the entire length of the enlarged section 14. The cutouts serve as a passageway for fluid traveling up the well bore between the well bore wall and the enlarged section. In the preferred embodiment enlarged section 14 has three cut-out portions disposed substantially 120° apart. The cut-out portions 18 define blades 20 of the enlarged section 14 therebetween. The arc of the outer circumference of the cut-out portion 18 measures substantially less than the arc of the outer circumference of blade 20, allowing blade 20 to be as wide as possible for greater strength and stability.

Blade 20 contains a longitudinal slot 22. The length of slot 22 is less than the length of the enlarged section 14 and is positioned within the enlarged section such that a guide section 24 of each blade, which is circumferentially unbroken by the opening of slot 22, enters the well bore prior to enlargement of the well bore 16. In the preferred embodiment this guide section is coated with hard facing such as tungsten carbide slugs to protect the tool from formation wear.

Cutting arm 26 is attached to blade 20 in slot 22. In the fixed-arm embodiment of the present invention the preferred means of attachment to blade 20 is via pins 28 extending through holes 30 in blade 20 and holes 32 in cutting arm 26. Preferably, the pins are held in place by snap rings. Cutting arm 26 is configured to have an inner edge 34, an outer edge 36 and cutting edges 38. Cutting arm 26 has two essentially parallel faces, leading face 37 and trailing face 39. The leading and trailing faces are essentially of polygonal configuration. The configuration of cutting edges 38 is such that cutting arm 26 contains a fluid gallery 40 between the cutting edges, which is substantially perpendicular to the well bore wall. Cutting arm 26 is attached to blade 20 so that inner edge 36 is essentially within the outer diameter of the enlarged section. Preferably, in the fixed-arm embodiment, inner edge 36 abuts against tubular housing member 12. Cutting arm 26 is preferably machined from "4142" grade steel in one piece.

Synthetic diamond material, preferably in the form of wafers 42, is attached to cutting arm 26. Wafers 42 may be attached to cutting edges 38, or preferably to the inner cutting face 44 located within fluid gallery 40 and leading cutting face 45 located on leading face 37 of each cutting arm, near cutting edges 38.

Tubular housing member 12 is formed with a longitudinal bore 46 therethrough for the passage of fluid. Within tubular housing member 12 and located near the cutting edges 38 and above guide section 24 are ports 52 which allow fluid from bore 46 to communicate with slot 22. Within port 52 is attached nozzles 54 which control the pressure and direction of the fluid therethrough such that a jet stream of fluid is directed through fluid gallery 40 to cool and clean cutting edges 38 and to keep slot 22 free of debris. In the preferred embodiment, nozzles 54 are positioned so as to direct fluid perpendicular to the well bore wall, attacking the planes of any sedimentary formation and aiding in breaking up such formation allowing for easier enlargement of the well bore.

In the expandable-arm embodiment of the present invention, referring to FIG. 2, tubular housing member 12 preferably comprises an upper tubular member 56 attached, preferably threadedly, to a main tubular member 58 attached, preferably threadedly, to a lower tubular member 60, with a longitudinal bore 46 therethrough. In the expandable-arm embodiment, bore 46 is not a fluid passageway. In the expandable-arm embodiment, main tubular member 58 houses enlarged section 14, which is formed, as previously described, with slots 22, blades 20 and cut-out portions 18.

Figure 6:
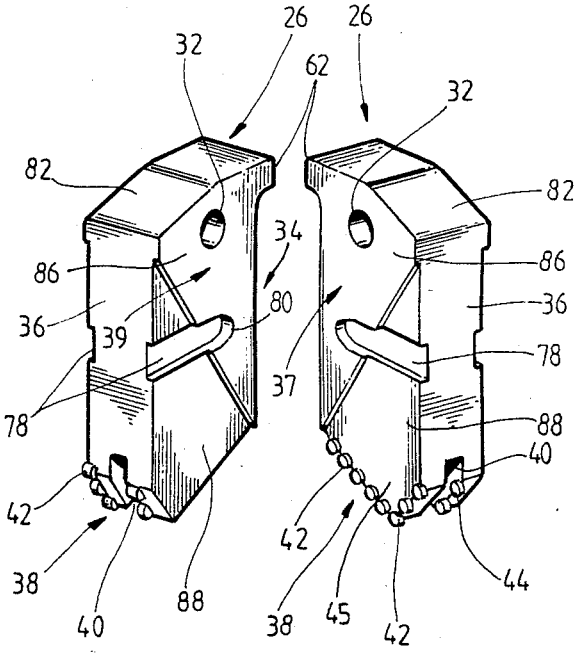
FIG. 6 is a perspective view of the cutting arms of the invention.

Cutting arm 26, as best seen in FIG. 6, is configured to have an inner edge 34, an outer edge 36 and cutting edges 38. Cutting arm 26 has two essentially parallel faces, leading face 37 and trailing face 39. The leading and trailing faces are essentially of polygonal configuration. The configuration of cutting edges 38 is such that cutting arm 26 contains a fluid gallery 40 between the cutting edges which, in the fully extended position of cutting arm 26, is substantially perpendicular to the well bore wall.

In the expandable-arm embodiment, cutting arm 26 is pivotally mounted to blade 20 within slot 22. The attachment is preferably made by pin 28 which extends through holes 30 in blade 20 and hole 32 in cutting arm 26. Pin 28 and holes 30 and 32 are positioned so as to allow strong outward turning moments when the tool is enlarging the well bore. Cutting arm 26 is configured so as to have a spur 62 projecting from its inner edge 34 at the top of cutting arm 26 towards bore 46.

Cutting arm 26 is movable between a radially retracted position, (Refer to X in FIG. 2) wherein arm 26 is disposed in slot 22 essentially within the outer diameter of enlarged section 14, and a radially extended position (refer to Y in FIG. 2), wherein inner edge 34 remains at all times essentially within the outer diameter of enlarged section 14 and cutting edges 38 are substantially outside the outer diameter of enlarged section 14.

The movement of cutting arm 26 is accomplished by the movement of a tubular drive member 64 within bore 46 and slidably connected therewith. In the preferred embodiment, tubular drive member 64 comprises piston 66, upper drive member 68, which is engaged by piston 66, middle drive member 70, threadably connected to upper drive member 68, and lower drive member 72, threadably connected to middle drive member 70. The upper drive member 68 has a groove 74 adapted to engage spur 62 on cutting arm 26.

In order to reduce shock loading and allow bending loads to be supported over the entire length of cutting arm 26, well bore enlarger 10 includes means for stopping the extension of cutter arm 26 to ensure that inner edge 34 of cutting arm 26 remains at all times essentially within the outer diameter of enlarged section 14 and that cutter arm 26 moves through only a small angle or arc. In the preferred embodiment the angle of arc through which cutting arm 26 moves is less than 30°. In the preferred embodiment such stop means comprise stop pins 76 which extend through blade 20 to slidingly engage stop pin slots 78 in cutting arm 26. When cutting arm 26 is fully extended, stop pin 76 abuts against wall 80 of stop pin slot 78 which is positioned on cutting arm 26 so as to ensure that inner edge 34 of cutting arm 26 remains at all times essentially within the outer diameter of enlarged section 14 while cutting edges 38 remain essentially outside the outer diameter of enlarged section 14 causing the creation of strong outward turning moments which force cutting arm 26 to remain in the open position when the well bore is being enlarged.

In the preferred embodiment, cutting arm 26 is configured so as to have back-up stop means in case of failure of the stop pin 76. The back-up stop means comprise stop edge 82 of cutter arm 26, adjacent to outer edge 36. Under ordinary conditions, stop edge 82 does not contact blade 20. Upon failure of stop pin 76, stop edge 82 abuts against upper wall 84 of slot 22 within blade 20, precluding further extension of cutting arm 26 and ensuring that inner edge 34 of cutting arm 26 remains at all times essentially within the outer diameter of enlarged section 14. Stop edge 82 is preferably located close to upper wall 84 when cutting arm 26 is fully extended, preventing entry of formation cuttings into slot 22 between stop edge 82 and upper wall 84.

In the preferred embodiment, as best seen in FIG. 6, leading face 37 and trailing face 39 are configured to have two plateaus. The high plateau 86 is that section of leading face 37 and trailing face 39 which at all times remains essentially within the outer diameter of enlarged section 14. The thickness of cutting arm 26 at any point on high plateau 86 is substantially the same as the width of slot 20, thus allowing for maximum strength of hinge pin 28. The lower plateau 88 is that section of leading face 37 and trailing face 39 which extends outside of the outer diameter of enlarged section 14. The width of cutting arm 26 at any point on lower plateau 88 is slightly less than the width of slot 22, thus allowing cutting arm 26 to move to its retracted position X even if the portion exposed to the well bore sustains some damage.

Figure 3:
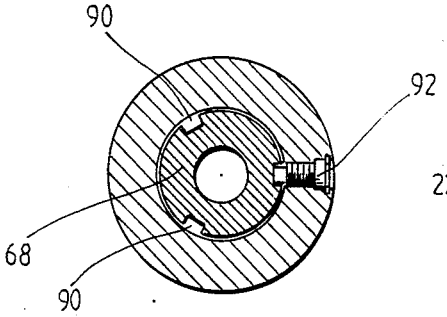
FIG. 3 is a cross-sectional view of the expandable-arm embodiment of the invention taken along the line 3—3.

In order to prevent tubular drive member 64 from rotating independently from tubular housing member 12, tubular drive member 64 contains longitudinal grooves 90, any one of which is slidingly engagable with orientation pin 92, best seen in FIG. 3. Orientation pin 92 is preferably engaged in hole 94 by means of a snap ring, hole 94 extending through tubular housing member 12. Groves 90 also function as fluid bypasses in the event of piston seal failure, to prevent fluid erosion within the tool.

In the expandable-arm embodiment of this invention, tubular drive member 64 has a longitudinal fluid passageway 96 therethrough. Within tubular drive member 64 and located near cutting edges 38 and above guide section 24 are ports 98 which allow fluid from passageway 96 to communicate with slot 22. Within port 98 is attached nozzle 100 which controls the pressure and direction of fluid therethrough such that a jet stream of fluid is directed through fluid gallery 40 to cool and clean cutting edges 38 and to keep slot 22 free of debris. Inner cutting face 44 is directly cooled by the jet stream of fluid through fluid gallery 40. Leading cutting face 45 is cooled by the jet stream through conduction and by forward leakage of the fluid as well as by fluid moving up the well bore through cut-out portions 18.

In the preferred embodiment, ports 98 are within middle drive member 70 and are positioned thereon so as to ensure that nozzles 100 direct fluid to fluid gallery 40 when the arms are in their fully extended position. In the preferred embodiment, nozzles 100 are positioned so as to direct fluid perpendicular to the well bore wall, attacking the planes of any sedimentary formation and aiding in breaking up such formation, allowing for easier enlargement of the well bore.

The number of grooves 90 in tubular drive member 64 corresponds to the number of cutting arms 26 and are preferably oriented so as to position ports 98 such that fluid is directed into slot 22.

Tubular drive member 64 is resiliently biased upwardly by a bias element, preferably spring 102, which is set against a cap ring and split ring assembly 104 slidably attached to lower drive member 72 and bearing against a shoulder 106 of tubular housing member 12 where bore 46 narrows. Upon downward movement of tubular drive member 64, the upper end of spring 102 is engaged by the lower end of middle drive member 70. The maximum downward movement of tubular drive member 64 is controlled by stop pin 76 and stop pin slot 78 and downward movement ceases when cutter arms 28 are in their fully extended position.

In the operation of the expandable-arm embodiment, movement of piston 66 is actuated by the flow of fluid through passageway 96. Tubular drive member 64 moves downward engaging and compressing spring 102. Groove 74 engages spur 62 and, upon further downward motion, cutting arms 26 extend outward. Tool 10 is rotated and downward weight is applied to the tool as enlarging of the well bore begins. Arms 26 continue to extend until stop pin 76 abuts against wall 80 of stop pin slot 78. At the point of full extension of cutting arms 26, further downward movement of tubular drive member 64 is prevented, and nozzles 100 are in position to jet fluid through fluid gallery 40 between the cutting edges 38. Fluid continues to flow through passageway 96 and out of well bore enlarger 10 through a decreased diameter passageway 108 which can be further reduced by attachment of nozzle 110, maintaining a pressure differential across the tool for the operation of open-ended systems below well bore enlarger 10. By controlling the size and ratio of nozzle 110 and nozzles 100, the pressure drop across the tool and the percent of flow of fluid to cutter arms 26 and downstream toward passageway 108 can be varied.

If sufficient back pressure is created below well bore enlarger 10, such as when the well bore enlarger is attached to a tricone bit fitted with nozzles, it is possible to maintain the pressure differential without the use of nozzle 110. Flow ratios can still be varied by controlling the flow area of the bit nozzles with respect to the flow area of nozzles 100.

After the well bore is enlarged, flow of fluid through passageway 96 is discontinued. Spring 102 then urges tubular drive member 64 upward which retracts cutting arms 26 to a position wherein the arms are disposed essentially within the outer diameter of enlarged section 14. Tool 10 is then removed from the well bore.

The foregoing description has been directed to particular embodiments of the invention in accordance with the Patent Statute for purposes of illustration and explanation. It will be apparent, however, to those skilled in this art that many modifications and changes in the well bore enlarger set forth will be possible without departing from the scope and spirit of the invention. It is intended that the following claims be interpreted to embrace all such modifications and changes.

What is claimed is:

1. A hole enlarger for enlarging a well bore comprising:

a tubular housing member having an enlarged section with an outer diameter substantially the same as the diameter of the well bore, the enlarged section having a plurality of longitudinal cut-out portions along its entire length, the cut-out portions defining blades of the enlarged section therebetween, the cutout portion's arc of outer circumference being smaller than the blade's arc of outer circumference to ensure strength and stability of the hole enlarger;

a longitudinal slot within the blade;

a cutting arm mounted to the blade within the slot, the cutting arm having cutting edges and a fluid gallery between the cutting edges, the fluid gallery communicating with the slot and the well bore;

synthetic diamond material attached to the cutting arm; and means on the tubular housing member for directing a fluid toward and through the fluid gallery of the cutting arm as the cutting arm enlarges the well bore.

2. The hole enlarger of claim 1 wherein the fluid directing means directs fluid essentially perpendicular to the well bore wall.

3. The hole enlarger of claim 1 wherein the cutting arm has an inner edge which remains at all times essentially within the outer diameter of the enlarged section.

4. The hole enlarger of claim 1 wherein the fluid gallery is substantially perpendicular to the well bore wall.

5. A hole enlarger for enlarging a well bore comprising:

a tubular housing member having an enlarged section with an outer diameter substantially the same as the diameter of the well bore;

a plurality of longitudinal cut-out portions extending along the entire length of the enlarged section, the cutout portions defining blades of the enlarged section therebetween, the cutout portion's arc of outer circumference being smaller than the blade's arc of outer circumference to ensure the strength and stability of the hole enlarger;

a cutting arm having inner, outer and cutting edges, the cutting arm pivotally mounted within the blade and movable between a radially retracted position wherein the cutting arm is disposed essentially within the outer diameter of the enlarged section, and a radially extended position;

stop means within the blade and engageable with the cutter arm to limit outward movement of the cutter arm so that the outer edge of the cutter arm is disposed essentially outside the diameter of the enlarged section and the inner edge of the cutting arm remains at all times essentially within the outer diameter of the enlarged section;

synthetic diamond material attached to the cutting arm;

a tubular drive member slidably mounted within the tubular housing member, the drive member including a piston actuated by hydraulic fluid;

means on the cutter arm and drive member for moving the cutter arm from its retracted position to its extended position; and means on the drive member for directing fluid toward the cutting edges of the cutting arm as the cutting arm enlarges the well bore.

6. The hole enlarger of claim 5 also comprising spring biasing means acting upon the drive member to urge the cutter arm to return to its retracted position.

7. The hole enlarger of claim 5 wherein the cutting arm is configured to create substantial outward turning moments about the pivotal mount when the cutting arm is enlarging the well bore.

8. The hole enlarger of claim 5 wherein the means for moving the cutter arm comprises a groove on the drive member which engages a spur projecting from the inner edge of the cutting arm.

9. The hole enlarger of claim 5 wherein the cutter arm is configured to have a leading face essentially parallel to a trailing face, the faces being of substantially polygonal configuration.

10. The hole enlarger of claim 9 wherein the stop means comprises stop pins which extend through the blade to slidingly engage stop pin slots on the leading and trailing faces of the cutter arm.

11. The hole enlarger of claim 10 further comprising back-up stop means comprising a stop edge on the cutter arm adjacent to the outer edge which stop edge engages the blade upon failure of the stop means, such engagement maintaining the inner edge of the cutter arm essentially within the outer diameter of the enlarged section.

12. The hole enlarger of claim 5 wherein the cutting arm has a fluid gallery between its cutting edges, the fluid gallery communicating with the fluid directing means and the well bore.

13. The hole enlarger of claim 12 wherein the fluid gallery is essentially perpendicular to the well bore wall when the cutter arm is in its extended position.

14. The hole enlarger of claim 12 wherein the fluid directing means directs fluid essentially perpendicular to the well bore wall.

15. A hole enlarger for enlarging a well bore comprising:

a tubular housing member having an enlarged section with an outer diameter substantially the same as the diameter of the well bore, the enlarged section having a plurality of longitudinal cut-out portions along its entire length, the cut-out portions defining blades of the enlarged section therebetween, the cutout portion's arc of outer circumference being smaller than the blade's arc of outer circumference to ensure strength and stability of the hole enlarger;

a longitudinal slot within the blade;

a cutting arm mounted to the blade within the slot, the cutting arm having cutting edges;

synthetic diamond material attached to the cutting arm; and means on the tubular housing member for directing a fluid toward the cutting arm as the cutting arm enlarges the well bore.

16. The hole enlarger of claim 15 wherein the fluid directing means directs fluid essentially perpendicular to the well bore wall.

* * * * *